US005123886A

United States Patent [19]

Cook

[11] Patent Number: 5,123,886

[45] Date of Patent: Jun. 23, 1992

[54] EXERCISE MACHINE WITH ADJUSTABLE GRIP POSITIONING MECHANISM

[76] Inventor: Brian R. Cook, 37118 SE. Gibson Rd., Washougal, Wash. 98671

[21] Appl. No.: 703,588

[22] Filed: May 20, 1991

Related U.S. Application Data

[63] Continuation of Ser. No. 468,716, Jan. 24, 1990, abandoned.

[51] Int. Cl.[5] ..... A63B 21/04

[52] U.S. Cl. ..... 482/129; 482/103; 482/121; 128/25 R

[58] Field of Search ..... 272/117, 119, 130, 134, 272/135-142, 143, 118; 128/25 R

[56] References Cited

U.S. PATENT DOCUMENTS

| | | | |
|---|---|---|---|
| 3,850,431 | 11/1974 | Winans | 272/118 |
| 4,328,965 | 5/1982 | Hatfield | 272/142 X |
| 4,603,855 | 8/1986 | Sebelle | 272/118 X |
| 4,634,127 | 1/1987 | Rockwell | 272/134 |
| 4,645,205 | 2/1987 | Wolff | 272/130 X |
| 4,685,670 | 8/1987 | Zinkin | 272/136 |
| 4,709,918 | 12/1987 | Grinblat | 272/134 X |
| 4,721,303 | 1/1988 | Fitzpatrick | 272/134 X |
| 4,725,057 | 2/1988 | Shifferaw | 272/134 X |
| 4,765,614 | 8/1988 | Shute | 272/130 |
| 4,826,157 | 5/1989 | Fitzpatrick | 272/134 |
| 4,898,381 | 2/1990 | Gordon | 272/117 |
| 4,911,435 | 3/1990 | Johns | 272/134 |

FOREIGN PATENT DOCUMENTS

| | | | |
|---|---|---|---|
| 1253654 | 8/1986 | U.S.S.R. | 272/118 |

*Primary Examiner*—Robert Bahr

*Attorney, Agent, or Firm*—Flehr, Hohbach, Test, Albritton & Herbert

[57] ABSTRACT

Exercise machine having a base comprising a horizontally extending platform and an upstanding post. A swing arm comprising has a pair of arms and a crossbar is pivotally mounted on the post for movement about a horizontally extending axis, with the crossbar extending in a direction generally parallel to the axis. A first pair of pulleys are mounted on the base in alignment with the horizontally extending axis, and a second pair of pulleys are mounted on the crossbar. A pair of cables are trained about the pulleys, grips are connected to the cables near the second pulleys, and resistance elements are connected to the cables for yieldably resisting movement of the cables when a pull is exerted thereon. A pair of telescoping arms extend between the base and the crossbar for holding the crossbar and the grips at different heights above the platform.

13 Claims, 1 Drawing Sheet

EXERCISE MACHINE WITH ADJUSTABLE GRIP POSITIONING MECHANISM

Figure 1:
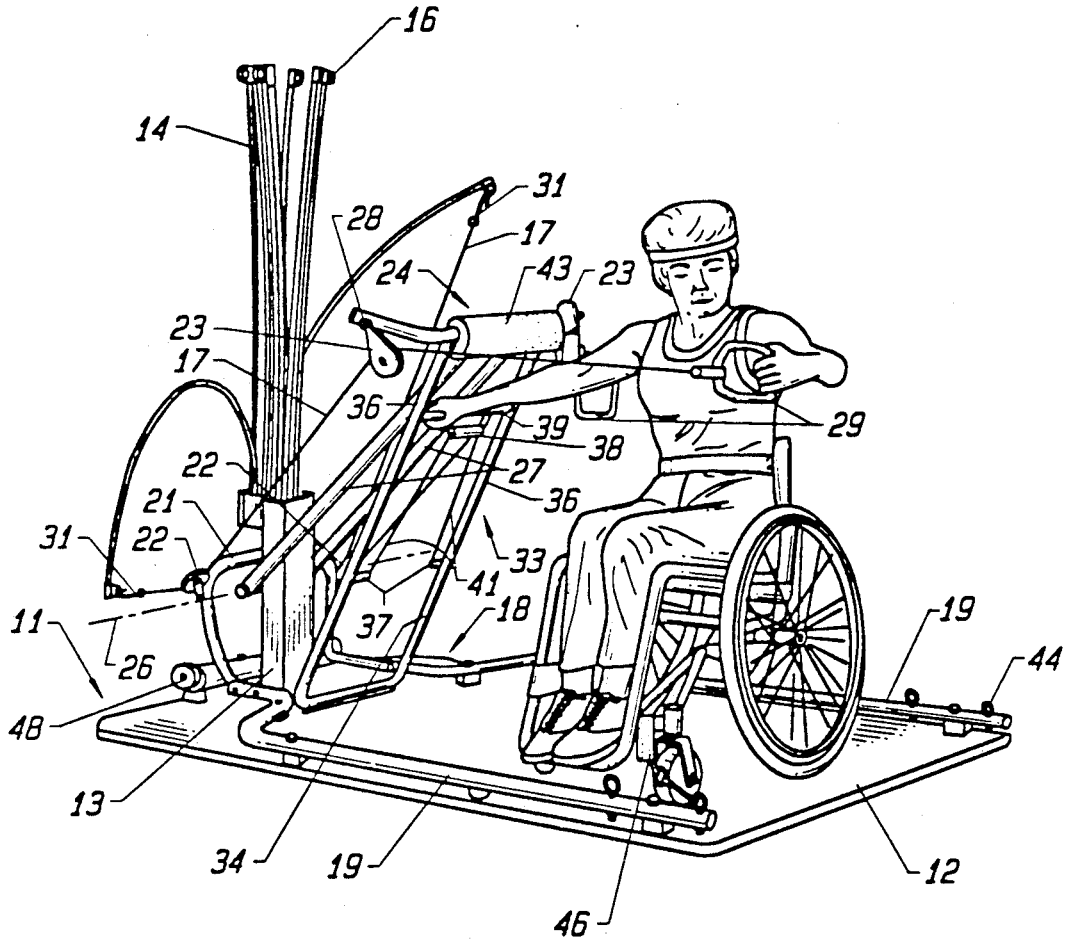

This is a continuation of application Ser. No. 07/468,716 filed Jan. 24, 1990, now abandoned.

This invention pertains generally to exercise machines and, more particularly, to an exercise machine of the type having cables upon which a pull is exerted by a person using the machine.

U.S. Pat. Nos. 4,620,704 and 4,725,057 disclose a universal exercise machine having resilient rods which are flexed in bow-like fashion to resist movement of a person using the machine. Forces are exerted on the rods through cables to which a variety of attachments such as hand grips, foot stirrups and a sliding bench can be connected to exercise different parts of the body. The rods can be used in different combinations to suit the requirements and physical abilities of the person using the machine.

With these and other machines utilizing cables, it is at times desirable to be able to position the free ends of the cables and the grips or other devices connected to the cables at different heights for different exercises and for different persons. This is particularly desirable for people in wheelchairs and other persons with limited ability to reach the cables in different positions.

U.S. Pat. Nos. 3,306,611 discloses an exercising apparatus in which a cable is trained about a pulley mounted on a pivotally mounted arm which can be moved up and down to position a hand grip at different heights. As the arm moves up, however, the free end of the cable gets shorter, and as it moves down, the free end gets longer.

U.S. Pat. No. 4,834,367 discloses a machine for performing supination and pronation exercises in which a cable is trained about a floating pulley, and the position of this pulley is adjusted to take up any slack in the cable when the position of the cable is changed.

U.S. Pat. No. 4,721,303 discloses an exercise machine having a pair of arms which can be rotated about axes generally parallel to the direction in which the pull is exerted to position a pair cables different distances apart. Guides for the cables are aligned with the axes of rotation and arranged to provide guidance for the cables regardless of the rotational positions of the arms.

It is in general an object of the invention to provide a new and improved exercise machine.

Another object of the invention is to provide an exercise machine of the above character which overcomes limitations and disadvantages of machines heretofore provided.

These and other objects are achieved in accordance with the invention by providing an exercise machine having a cable trained about a first guide mounted in a substantially fixed position and a second guide carried by a swing arm which pivots about an axis aligned with the first guide to adjust the position of the cable without changing the length of the cable or the tension in the cable.

FIG. 1 is a perspective view of one embodiment of an exercise machine incorporating the invention.

As illustrated in the drawing, the exercise machine includes a base 11 which comprises a horizontally extending platform 12 adapted to rest on the floor or other suitable supporting surface. An upright post 13 is affixed to the platform toward one end thereof, and a plurality of resilient rods 14 extend in an upward direction from the post. The rods are mounted in cantilevered fashion, with the lower ends of the rods being affixed to the post and the upper ends being free to move about. The free ends are provided with rings 16 to which cables 17 are connected to bend the rods in bow-like fashion when a pull is exerted thereon. The rods are fabricated of nylon or other suitable resilient material, and they are of different sizes to provide different amounts of bending resistance. Each of the cables can be connected to one or more of the rods to provide any amount of resistance desired.

The base also includes a frame 18 having a pair of side rails 19 which are affixed to the lower portion of the post and extend along opposite sides of the platform 12. An inverted U-shaped brace 21 is connected to the side rails and to the upper portion of the post to maintain the post in an upright position, and guide pulleys 22 are mounted on the brace on opposite sides of the post. Cables 17 are trained about these pulleys, and a pull exerted on the cables pulls the upper portions of the rods to which the cables are connected toward the pulleys, thereby bending the rods in bow-like fashion.

A second set of guide pulleys 23 is mounted on a swing arm 24 which is pivotally mounted on the post for movement about a horizontally extending axis 26. This axis extends transversely of the platform and is aligned with the first set of pulleys. The swing arm comprises a pair of arms 27 and a bar 28, with the lower ends of the arms being pivotally connected to the post and the bar being affixed to the upper ends of the arms and extending in a direction generally parallel to the pivot axis 26. The end portions of the bar extend back at an angle of about 45 degrees relative to the central portion, and the pulleys 23 are mounted on swivel mounts near the outer ends of the end portions. With this arrangement, the pulleys are free to swivel to maintain proper alignment with the cables, and they are positioned to the rear of the central portion of the bar where they do not interfere with a person using the machine. In addition, this arrangement enables people with broader or narrower shoulders to use the machine without adjusting the positions of the pulleys, and it makes the height of the bar less critical.

Hand grips 29 are connected to the free ends of the cables 17, and the length of the cables is preferably such that the hand grips are drawn up against guide pulleys 23 to maintain a small tension in the cables in the rest position. The hand grips can be of any desired type, including the stirrup-shaped handles illustrated, a single bar or any other suitable devices for exerting a pull on the cables. The cables can likewise be of any suitable type, including wire, rope and the like. The cables are provided with suitable connectors 31 to permit them to be readily attached to and disconnected from rings 16.

Means is provided for retaining the swing arm in a desired position with bar 28 and hand grips 29 a desired height above the platform. This means includes an adjustable strut or brace assembly 33 comprising a base section comprising a pair of L-shaped legs 34 which are pivotally mounted on platform 12 and a pair of tubular arms 36 which are telescopically mounted on the legs of the base section and connected to the crossbar. The tubular arms are retained in different positions on the base section by detent pins 37 which are operated by a handle 38 mounted on a cross member 39 which extends between the tubular arms. The handle is connected to the pin assemblies by cables 41, and squeezing the handle and the cross member together tensions the cables to disengage the detent pins and permit the length of the struts to be adjusted. The handle can be mounted on the cross member in any suitable fashion, and in one present embodiment it comprises a short tubular member which is suspended from the cross member by an elastic cord, with a single cable interconnecting the detent pins and passing through the handle. The elastic cord also passes through the tubular handle maintains a slight tension in the cable and to prevent it from sagging. Coil springs (not shown) are positioned within the tubular arms and function as counterweights to make it easier to raise and lower the bar and grips.

A padded cushion 43 is mounted on the crossbar 28 for receiving the head, shoulders, neck, or other part of the body of a person using the machine for certain exercises.

This machine is particularly suitable for use by a person in a wheelchair or other chair, and means is included for retaining a chair in a desired position on the platform. In the embodiment illustrated, this means includes eyebolts 44 mounted on side rails 19 and straps 46 extending between the eyebolts and the chair. While only two such eyebolts are mounted on each rail in the embodiment illustrated, any number of eyebolts or other suitable anchors can be provided at suitable locations along the rails.

A pair of wheels or rollers 48 are mounted near the edge of the platform behind post 13 to facilitate movement of the machine. These wheels are offset above and to the rear of the edge of the platform and are normally out of engagement with the ground or floor. For movement, the machine can be tipped to the rear to bring the wheels into engagement with the ground.

In operation, cables 17 are connected to the rods which provide the desired resistance for a given exercise, and strut assembly 33 is adjusted to position crossbar 28 and hand grips 29 at the proper height for the exercise and the person using the machine. If the person using the machine is in a wheelchair, the chair is moved to the appropriate position on the platform for the exercise and, if necessary, anchored to the machine with one or more straps 46. Because the axis 26 about which the swing arm pivots is aligned with pulleys 22, the distance between pulleys 22 and pulleys 23 does not change when the position of the handles is adjusted, and the tension in the cables is independent of the position of the handles. The manner in which the end portions or the crossbar are bent back and pulleys 23 are free to swivel enables people having broader and narrower shoulders to use the machine without having to move the pulleys, and it also makes the adjustment of the bar less critical. The bar and handles can be adjusted through a wide range of heights from floor level to shoulder level, or above.

In the embodiment illustrated, the post and frame are affixed to the platform, and a person using the machine rests on the platform. The machine is thus self-contained and is readily moved from place to place. If desired, however, the platform can be eliminated, and the post, the frame and the strut assembly can be attached to the floor or to a wall, in which case the floor or the ground would serve as the platform.

It is apparent from the foregoing that a new and improved exercise machine has been provided. While only one presently preferred embodiment has been described in detail, as will be apparent to those familiar with the art, certain changes and modifications can be made without departing from the scope of the invention as defined by the following claims.

I claim:

1. In an exercise machine: a horizontally extending platform for receiving a person using the machine, an upstanding post toward one end of the platform, a pair of elongated generally parallel arms pivotally mounted on the post and extending in a lengthwise direction over the platform for movement about a horizontally extending axis, a crossbar affixed to the arms and extending in a horizontal direction parallel to the axis for movement to different heights above the platform as the arms are pivoted about the axis, a first guide mounted in alignment with the axis, a second guide mounted on the crossbar, a cable trained about the guides and adapted to be pulled by the person using the machine, and means connected to the cable for yieldably resisting movement of the cable when a pull is exerted thereon.

2. The exercise machine of claim 3 including a strut of adjustable length connected between the swing arm and the base for holding the swing arm in different positions.

3. The exercise machine of claim 1 wherein the means for resisting movement of the cable comprises a resilient rod mounted on the post in cantilevered fashion with one end of the rod being secured in a fixed position and the other end being free.

4. The exercise machine of claim 1 including means for holding the arms in different positions with the crossbar at different heights above the platform.

5. The exercise machine of claim 1 including struts of adjustable length extending between the platform and the arms for holding the crossbar at different heights above the platform.

6. The exercise machine of claim 5 wherein the strut comprises a pair of telescoping arms and a cross arm extending between the telescoping arms.

7. The exercise machine of claim 1 including means for securing a wheelchair in a predetermined position on the platform.

8. The exercise machine of claim 1 wherein the swing arm includes a crossbar extending in a direction parallel to the axis and having the second guide mounted thereon.

9. In an exercise machine: a base comprising a horizontally extending platform and an upstanding post, a swing arm comprising a pair of arms pivotally mounted on the post for movement about a horizontally extending axis and a crossbar affixed to the outer ends of the arms and extending in a direction generally parallel to the axis, a first pair of pulleys mounted on the base in alignment with the horizontally extending axis, a second pair of pulleys mounted on the crossbar, a pair of cables trained about the pulleys, gripping means connected to the cables near the second pulleys, means connected to the cables for yieldably resisting movement of the cables when a pull is exerted thereon, and a pair of telescoping arms extending between the base and the crossbar for holding the crossbar and the gripping means at different heights above the platform.

10. The exercise machine of claim 9 wherein the crossbar has a central portion which is generally parallel to the axis and end portions which extend at an angle toward the post from the central portion, the second pair of pulleys being mounted on the end portions of the crossbar and being free to swivel as the cables are pulled in different direction therefrom.

11. The exercise machine of claim 10 including means for holding a wheelchair in a predetermined position on the platform.

12. In an exercise machine: a base, a swing arm pivotally mounted on the base for movement about a horizontally extending axis, said swing arm having a crossbar with a central portion which is generally parallel to the horizontally extending axis and end portions which extend at an angle from the central portion, a first pair of guides mounted on the base in alignment with the axis, a second pair of guides carried by the swing arm, a pair of cables trained about the guides, means connected to the cables for yieldably resisting movement of the cables when a pull is exerted thereon, grip means connected to the cables near the second guides, the second pair of guides comprising pulleys which are mounted on the end portions of the crossbar and are free to swivel as the cables are pulled in different direction therefrom, and means for holding the swing arm in different positions about the horizontally extending axis to adjust the height o the grip means without changing the tension in the cables.

13. In an exercise machine: a horizontally extending platform for receiving a person using the machine, an upstanding post toward one end of the platform, a swing arm extending over the platform in an upward direction from one end of the platform toward the other and being movable about an axis extending transversely of the platform near the one end, said swing arm comprising a pair of arms having inner ends pivotally connected to the post and outer ends positioned above the platform and a crossbar connected to the outer ends of the arms, a headrest mounted on the crossbar, a first guide mounted in a substantially fixed position in alignment with the axis, a second guide carried by the swing arm for movement to different heights above the platform as the swing arm is moved to different positions about the axis, a cable trained about the guides and adapted to be pulled by the person using the machine, and means connected to the cable for yieldably resisting movement of the cable when a pull is exerted thereon.

* * * * *